US009726456B1

(12) United States Patent
Jhu et al.

(10) Patent No.: US 9,726,456 B1
(45) Date of Patent: Aug. 8, 2017

(54) BLOW GUN

(71) Applicants: Li-Tang Jhu, Taichung (TW); Chiu-Chu Chuang, Taichung (TW); Bo-Ming Jhu, Taichung (TW)

(72) Inventors: Li-Tang Jhu, Taichung (TW); Chiu-Chu Chuang, Taichung (TW); Bo-Ming Jhu, Taichung (TW)

( * ) Notice: Subject to any disclaimer, the term of this patent is extended or adjusted under 35 U.S.C. 154(b) by 0 days.

(21) Appl. No.: 15/131,044

(22) Filed: Apr. 18, 2016

(51) Int. Cl.
*F41B 11/70* (2013.01)

(52) U.S. Cl.
CPC ..... *F41B 11/70* (2013.01)

(58) Field of Classification Search
CPC ..... B05B 9/01; B05B 12/002; B05B 1/3026; F41B 11/70
See application file for complete search history.

(56) References Cited

U.S. PATENT DOCUMENTS 3,698,644 A * 10/1972 Nystuen ..... B05B 7/0408 239/318
3,743,186 A * 7/1973 Mocarski ..... B05B 1/005 239/413
4,998,672 A * 3/1991 Bordaz ..... B05B 7/32 239/307
5,984,207 A * 11/1999 Wang ..... B05B 1/3013 239/526
6,390,390 B1 * 5/2002 Hung ..... B05B 1/3013 239/525
6,431,468 B1 * 8/2002 Brown ..... B05B 7/1209 222/145.5
2005/0001070 A1 * 1/2005 Wu ..... B05B 1/3013 239/526
2011/0253810 A1 * 10/2011 Rieger ..... B05B 7/12 239/526
2015/0273485 A1 * 10/2015 Tiberghien ..... B05B 1/005 239/526

* cited by examiner

*Primary Examiner* — Christopher Kim

(57) ABSTRACT

A blow gun includes a body with first and second paths, a trigger, a control unit, a first spring, a second spring and a first pin. The control unit includes a control member, a bar, a seal ring, an end member, a collar and a fastening member. The control member is received in the first room and has a slot located corresponding to the first hole. The end member is connected to the control member and the seal ring is mounted to the end member to seal the communication between the first and second paths. The first spring is biased between body and the control unit. The second spring is biased between the body and the trigger. The first pin extends through the first hole and is movable in the slot of the control member. The two springs share the force applied thereto to have a long service life.

5 Claims, 9 Drawing Sheets

BLOW GUN

BACKGROUND OF THE INVENTION

1. Fields of the Invention

The present invention relates to a blow gun, and more particularly, to a blow gun having two springs which share the force applied thereto so as to have a long service life.

2. Descriptions of Related Art

The conventional blow gun is disclosed in Taiwan Patent Publication Number 264733 and comprises a body with a first path for introducing air into the body, and a second path for releasing air out from the body. A first hole and a second hole are located between the first and second paths such that a valve unit is pivotably installed thereto. The body has two plates and each plate has a hole. The trigger has two protrusions are pivotably connected to the two holes of the two plates. A stop is located at outside of the body and close to the second path. The first hole includes an inclined portion at the outlet thereof. The trigger has a nose which contacts the outside of the inclined portion. A belly is formed beneath the nose. The nose has a curved portion at the top thereof and a vertical stop portion is located at the distal end of the curved portion. The vertical stop portion is located at the outside of the stop of the body. The valve unit is composed of a spring and a rod, wherein the spring is engaged with the first hole, the rod has an enlarged portion which contacts the spring. The shank of the rod is inserted in the second hole and has two O-rings mounted thereto. The enlarged portion has a semi-circular portion and the shank has a smaller section which has an elongate hole defined therethrough which is located in the first hole. The semi-circular portion contacts the belly of the trigger.

When the user pulls the trigger, the spring is compressed by the enlarged portion of the rod so that the elongate hole, the first path and the second path are in communication with each other. However, there is only one spring in the body of the blow gun, and the spring tends to reach its fatigue point after frequent operations of the trigger. Once the spring fails to response, the blow gun cannot be used.

The present invention intends to provide a blow gun to eliminate the shortcomings mentioned above.

SUMMARY OF THE INVENTION

The present invention relates to a blow gun and includes a body, a trigger, a control unit, a first spring, a second spring and a first pin. The body includes a first path for introducing air into the body, and a second path for releasing air out from the body. The body further includes a first room, a second room, a shoulder and a first hole. The trigger is pivotably connected to the body. The control unit includes a control member, a bar, a seal ring, an end member, a collar and a fastening member. The control member is received in the first room and has a slot located corresponding to the first hole. A groove is defined in the outside of the control member and the seal ring is engaged with the groove. The end member is connected to the control member and the seal ring is mounted to the end member to seal the communication between the first and second paths. The first spring is biased between body and the control unit. The second spring is biased between the body and the trigger. The first pin extends through the first hole and is movable in the slot of the control member. The two springs share the force so as to have a longer service life.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
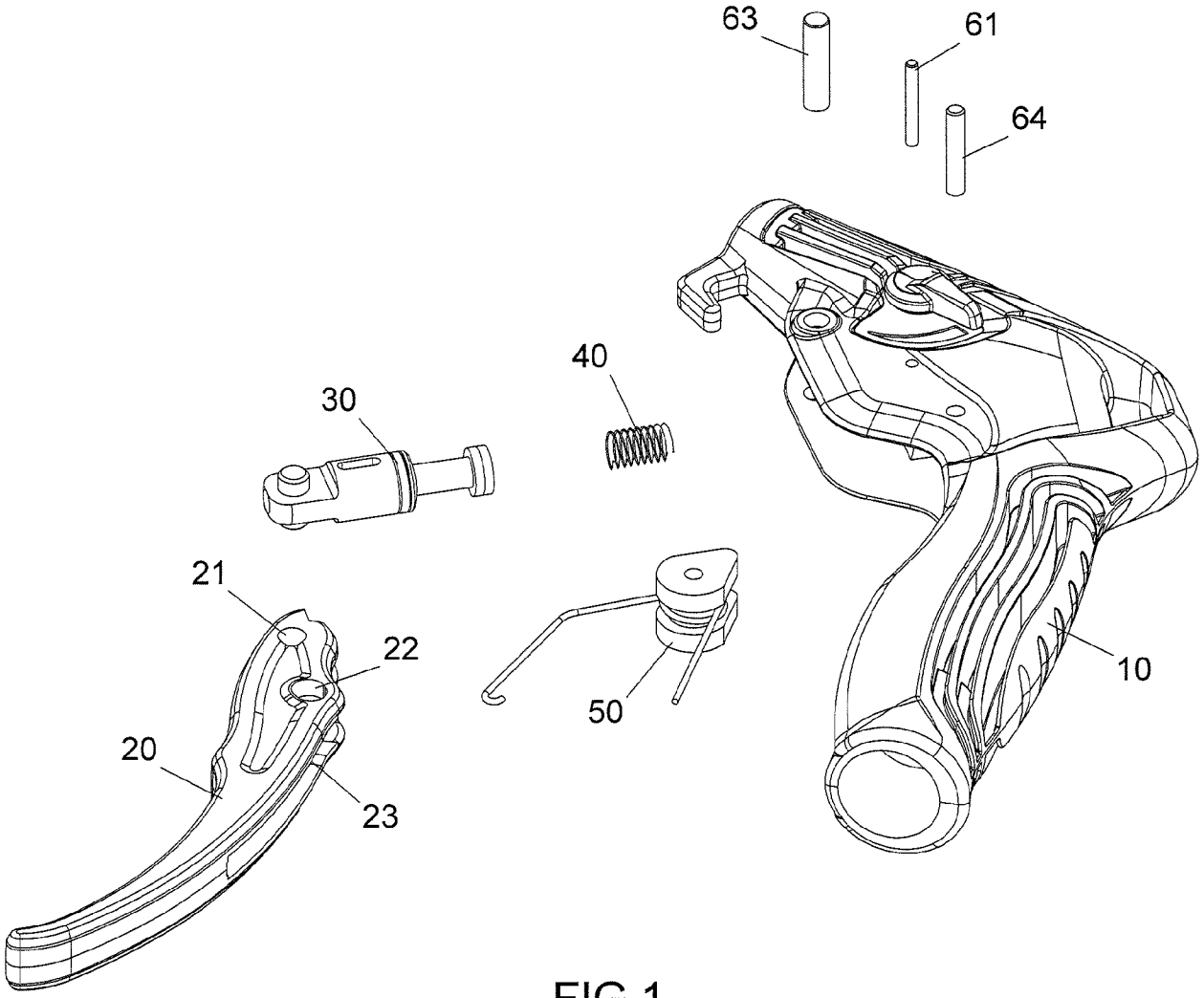
FIG. 1 is an exploded view of the blow gun of the present invention.
Figure 3:
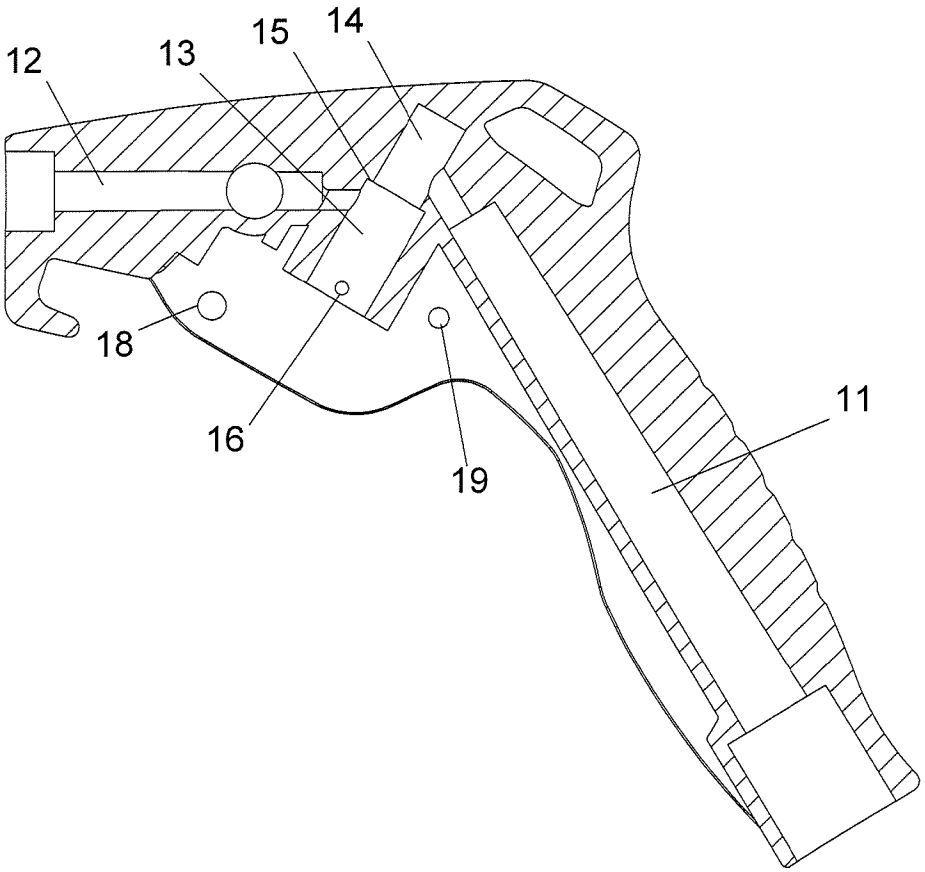
FIG. 3 is a cross sectional view, taken along line 3-3 in FIG. 2.
Figure 2:
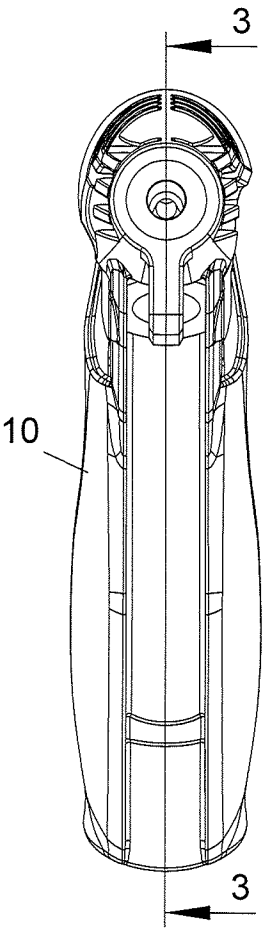
FIG. 2 is a front end view of the blow gun of the present invention.
Figure 4:
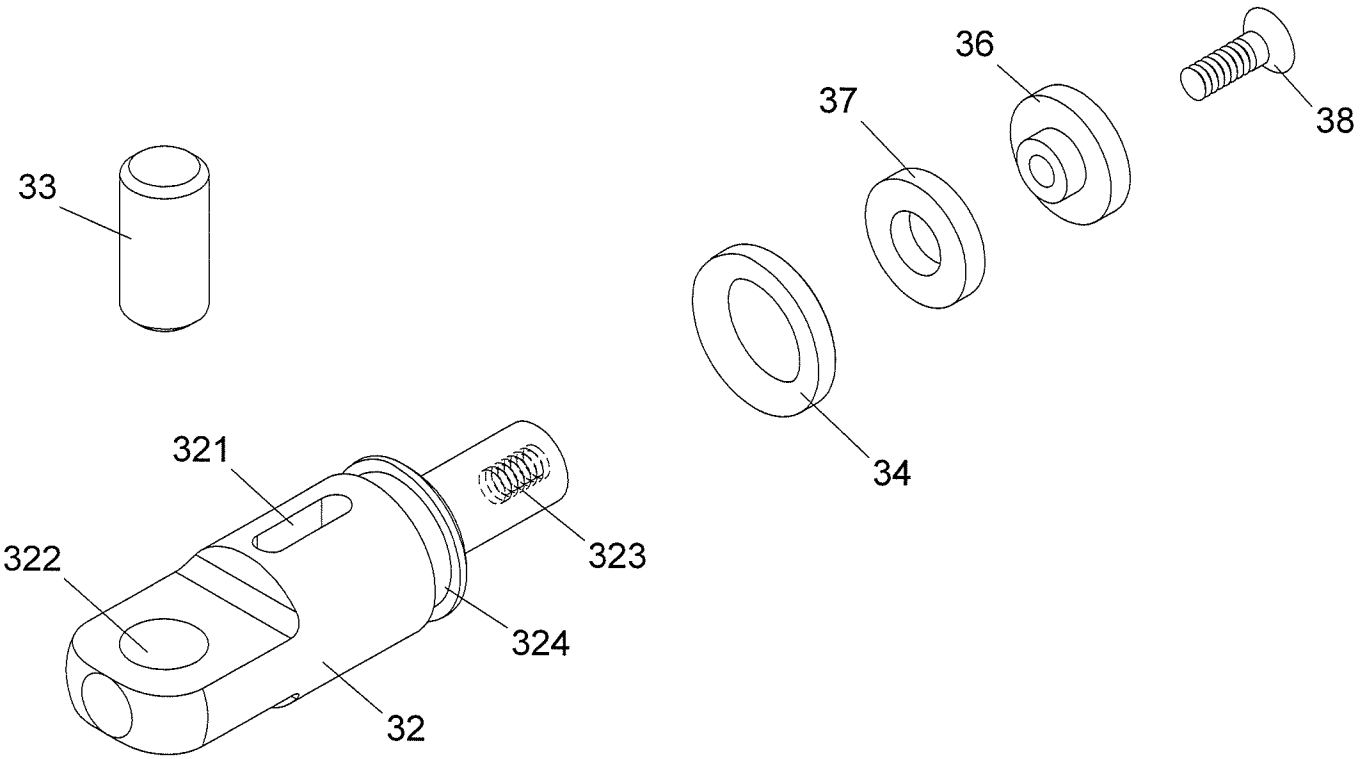
FIG. 4 is an exploded view of the control unit of the blow gun of the present invention.
Figure 5:
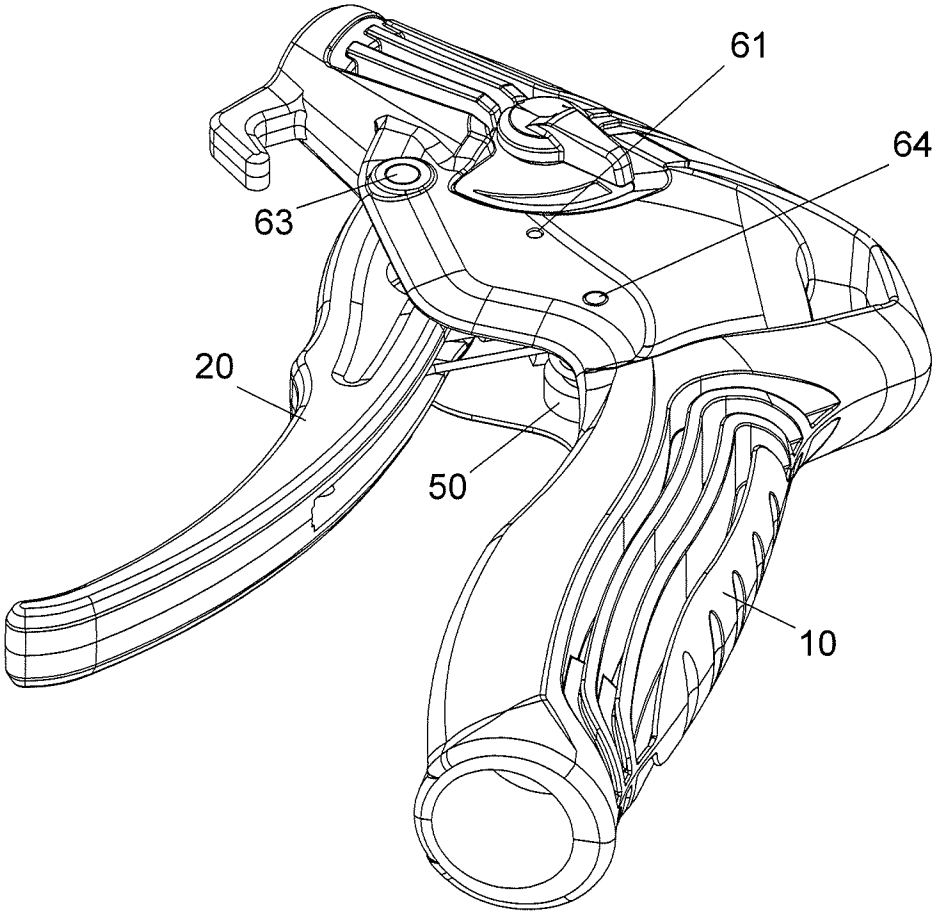
FIG. 5 is a perspective view to show the blow gun of the present invention.

Referring to FIGS. 1 to 8, the blow gun of the present invention comprises a body 10 having a first path 11 for introducing air into the body 10, and a second path 12 for releasing air out from the body 10. A first room 13 and a second room 14 are located between the first and second paths 11, 12, wherein the first room 13 communicates with the second path 12, and the second room 14 communicates with the first path 11. The first and second rooms 13, 14 communicate with each other. The diameter of the first room 13 is larger than that of the second room 14 so as to form a shoulder 15 between the first and second rooms 13, 14. A first hole 16 is defined in the body 10 and located close to an opening of the first room 13. The first hole 16 communicates with the first room 13. A first pivotal portion 18 is defined in the body 10 and located close to the second path 12. A second pivotal portion 19 is defined in the body 10 and located close to the first path 11.

A trigger 20 is pivotably connected to the body 10 and has a third pivotal portion 21 which is pivotably connected to the first pivotal portion 18. A fourth pivotal portion 22 is an elongate hole and defined through the trigger 20. The trigger 20 has a third pivotal portion 21 which faces the body 10. A control unit 30 is located between the body 10 and the trigger 20, wherein the control unit 30 has a control member 32, a bar 33, a seal ring 34, an end member 36, a collar 37 and a fastening member 38. The control member 32 is received in the first room 13 and has a slot 321 which is located corresponding to the first hole 16. A fifth pivotal portion 322 is defined in the first end of the control member 32 and pivotably connected to the fourth pivotal portion 22 of the trigger 20. A connection portion 323 is defined in the second end of the control member 32 and has inner threads. A groove 324 is defined in the outside of the control member 32 and located close to the slot 321. The bar 33 pivotably extends through the fourth and fifth pivotal portions 22, 322 to pivotably connect the trigger 20 to the control member 32.

The seal ring 34 is engaged with the groove 324 of the control member 32 so that the inner periphery of the first room 13 snugly contacts the outside of the control member 32. The end member 36 is a ring-shaped member and connected to the second end of the control member 32. The collar 37 is mounted to a protrusion of the end member 36 and located between the control member 32 and the end member 36. The collar 37 is located to seal the first path 11 relative to the second path 12. The collar 37 seals the second room 14. The outer diameter of the collar 37 and the end member 36 is equal to the inner diameter of the second room 14. The fastening member 38 extends through the end member 36 and is threadedly connected to the connection portion 323 of the control member 32 to connect the end member 36, the collar 37 and the control member 32 together.

When the control member 32 moves in the first room 13, the control member 32 drives the end member 36 and the collar 37 to move in the second room 14. When the trigger 20 is pivoted, the trigger 20 drives the control member 32 to move within the first and second rooms 13, 14. The end member 36 and the collar 37 are moved with the control member 32 so that the collar 37 does not located at the opening of the first room 13 such that the first path communicates with the second path 12.

A first spring 40 is biased between the inner end of the second room 14 of the body 10 and the end member 36 of the control unit 30 so as to provide a recovery force to the control member 32, the end member 36 and the collar 37. A second spring 50 is located in the third room 23 and biased between the body 10 and the trigger 20. The second spring 50 provides a recovery force to the trigger 20, wherein the second spring 50 is a torsion spring and has a central hole which is located corresponding to the second pivotal portion 19.

A first pin 61 extends through the first hole 16 and is located in the slot 321. The first pin 61 is movable within the slot 321. When the control member 32 moves in the first room 13, the first pin 61 and the slot 321 restrict the maximum movement of the control member 32. When the control member 32 returns, the first pin 61 contacts one of two inner ends of the slot 321. A third pin 63 pivotably extends through the first and third pivotal portions 18, 21 to pivotably connect the trigger 20 to the body 10. A fourth pin 64 pivotably extends through the second pivotal portion 19 and the central hole of the second spring 50 to restrict the second spring 50 from disengaging from the body 10.

Figure 8:
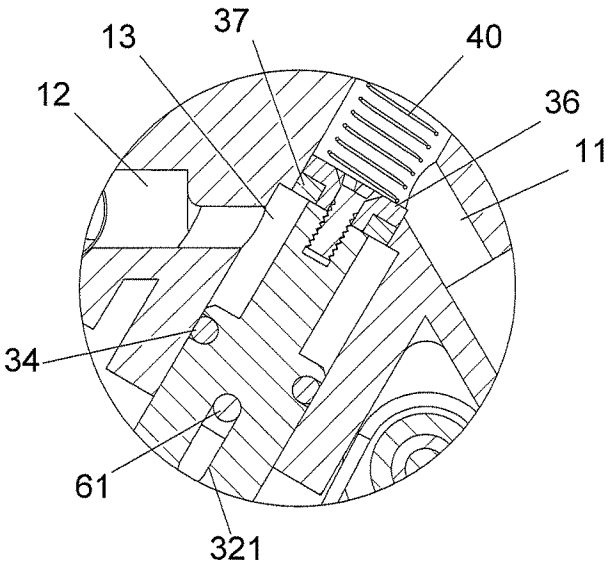
FIG. 8 is an enlarged view of the circled "C" in FIG. 7.
Figure 7:
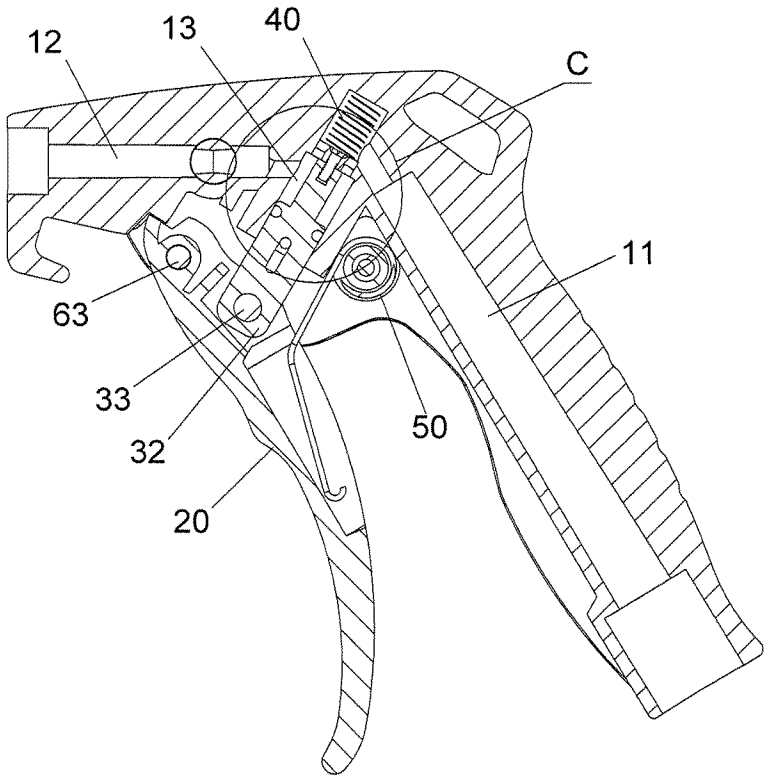
FIG. 7 is a cross sectional view, taken along line 7-7 in FIG. 6.
Figure 6:
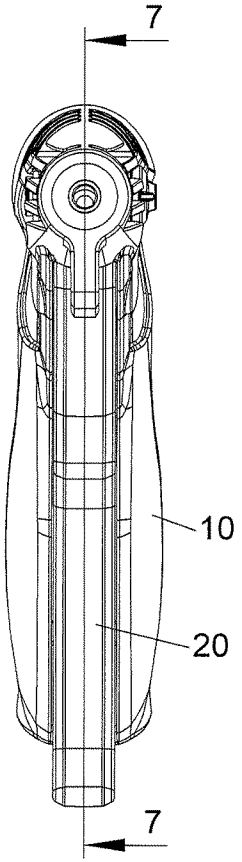
FIG. 6 is a front end view of the blow gun of the present invention.
Figure 10:
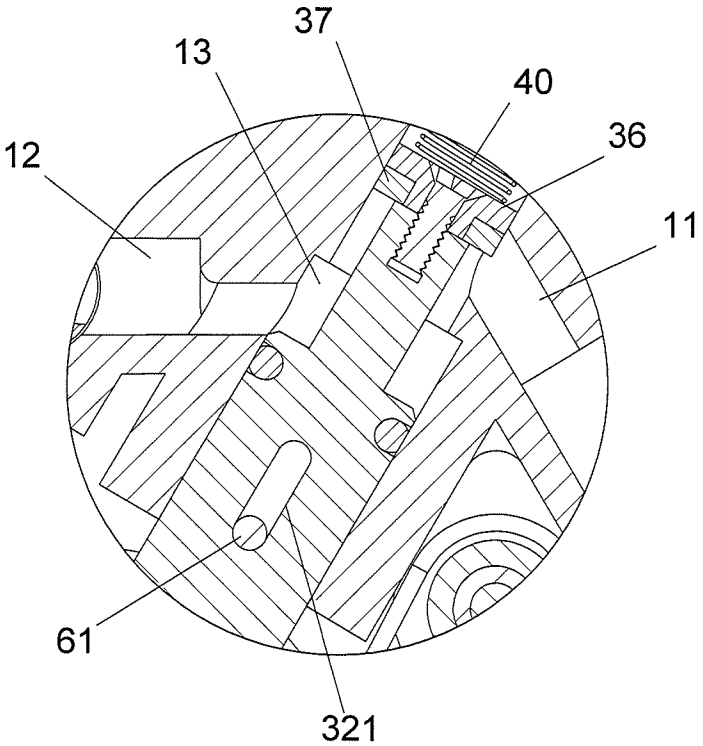
FIG. 10 is an enlarged view of the circled "C" in FIG. 9.
Figure 9:
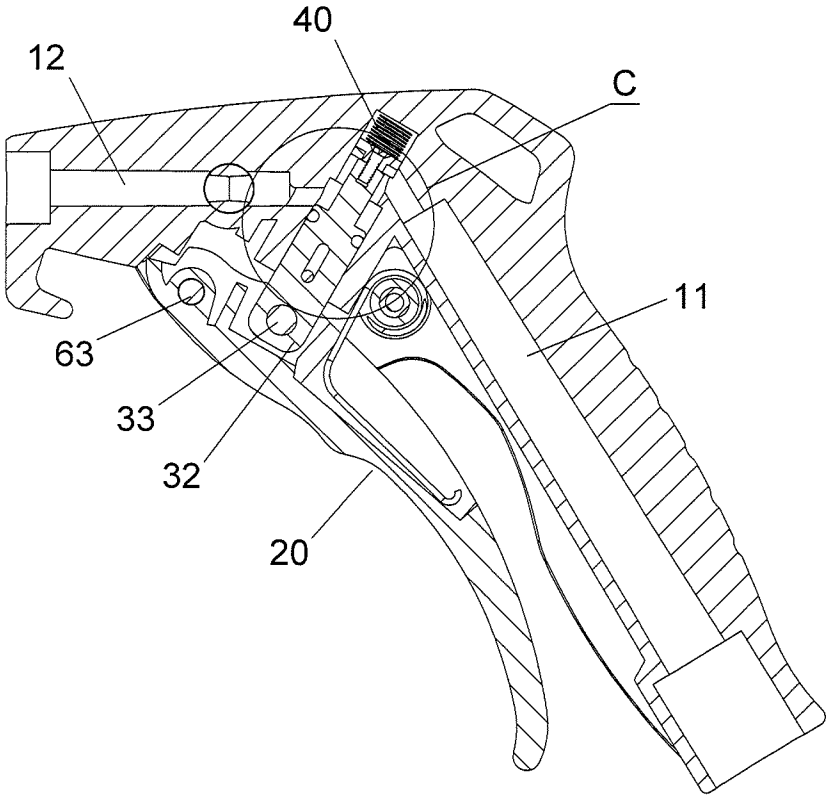
FIG. 9 is a cross sectional view, taken along line B-B in FIG. 6, showing another operational status.

As shown in FIGS. 9 and 10, when the user pulls the trigger 20, the trigger 20 drives the control member 32 to move within the first and second rooms 13, 14. The first pin 61 contacts the other inner end of the slot 321. Because the outer diameter of first end of the control member 32 is the same as the inner diameter of the first room 13, and the outer diameter of the second end of the control member 32 is smaller than the inner diameter of the first and second rooms 13, 14, so that when the control member 32 moves inward, the end member 36 moves to compress the first spring 40. The first room 13 is opened, and there is a gap between the control member 32 and the second room so that the second room 14 communicates with the first room 13, and the first path 11 communicates with the second path 12. The pressurized air enters into the second room 14 and the first room 13 via the first path 11, and the pressurized air exits from the blow gun via the second path 12. When the trigger 20 is released, both of the first and second springs 40, 50 return, the control member 32 moves back to the position as shown in FIG. 8, so that no pressurized air is released from the second path 12.

Figure 11:
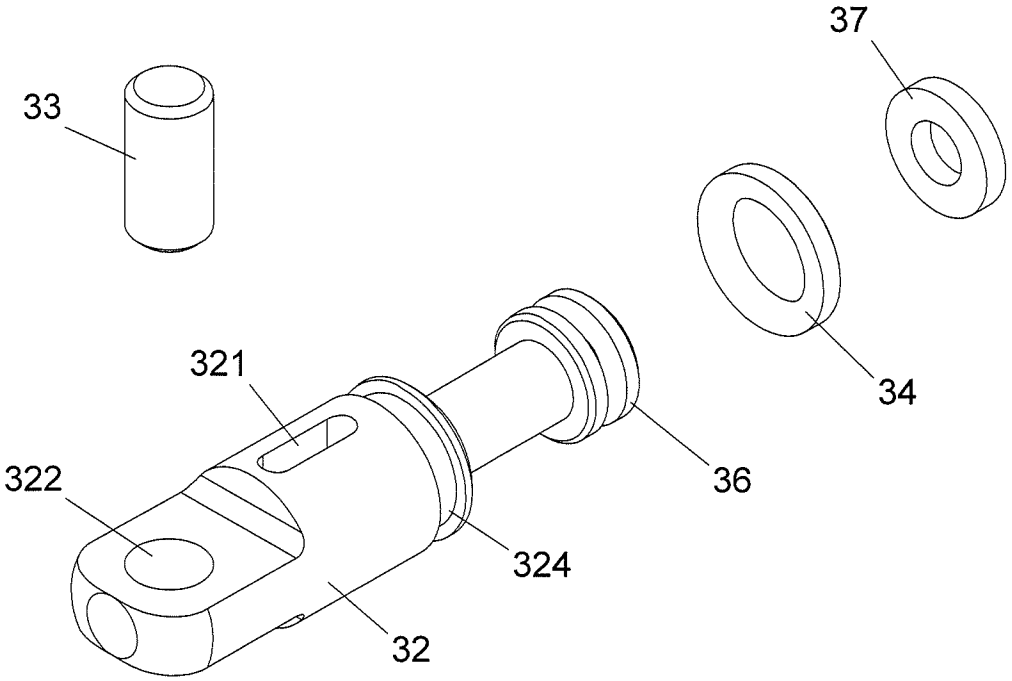
FIG. 11 is an exploded view of the control unit of the second embodiment of the blow gun of the present invention.

As shown in FIG. 11, the control member 32 and the end member 36 are integral to each other. The control unit 30 does not have the fastening member 38.

Figure 13:
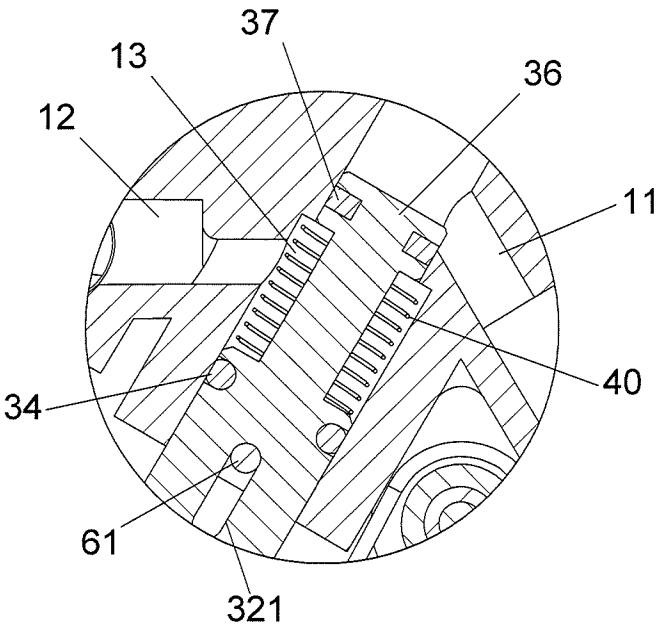
FIG. 13 is an enlarged view of the circled "C" in FIG. 12.
Figure 12:
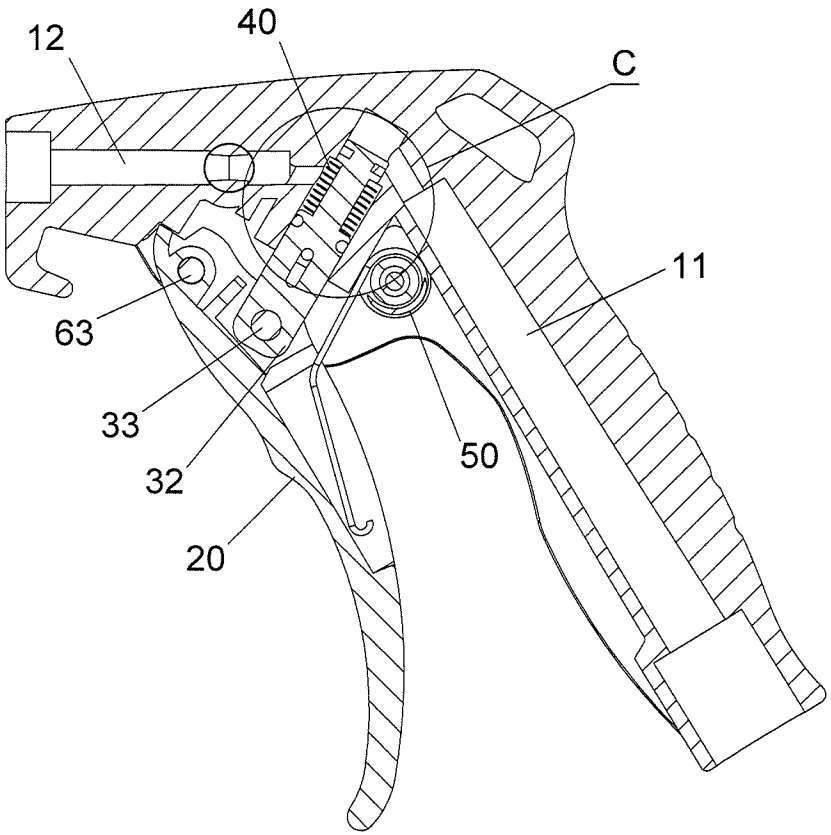
FIG. 12 is a cross sectional view of the second embodiment of the blow gun of the present invention.

As shown in FIGS. 12 and 13, the first spring 40 is received in the first room 13 and mounted to the control member 32, and the first spring 40 is biased between the control member 32 and the shoulder 15.

Figure 15:
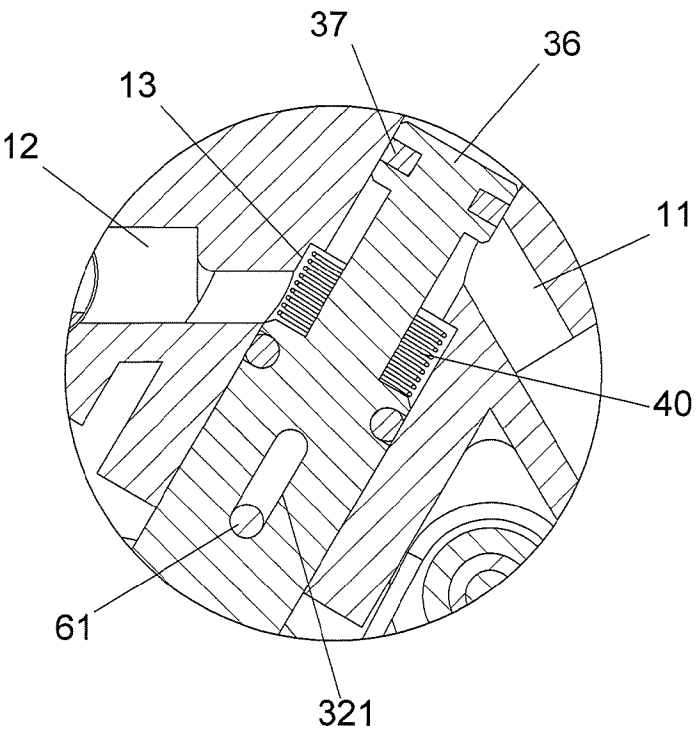
FIG. 15 is an enlarged view of the circled "C" in FIG. 14.
Figure 14:
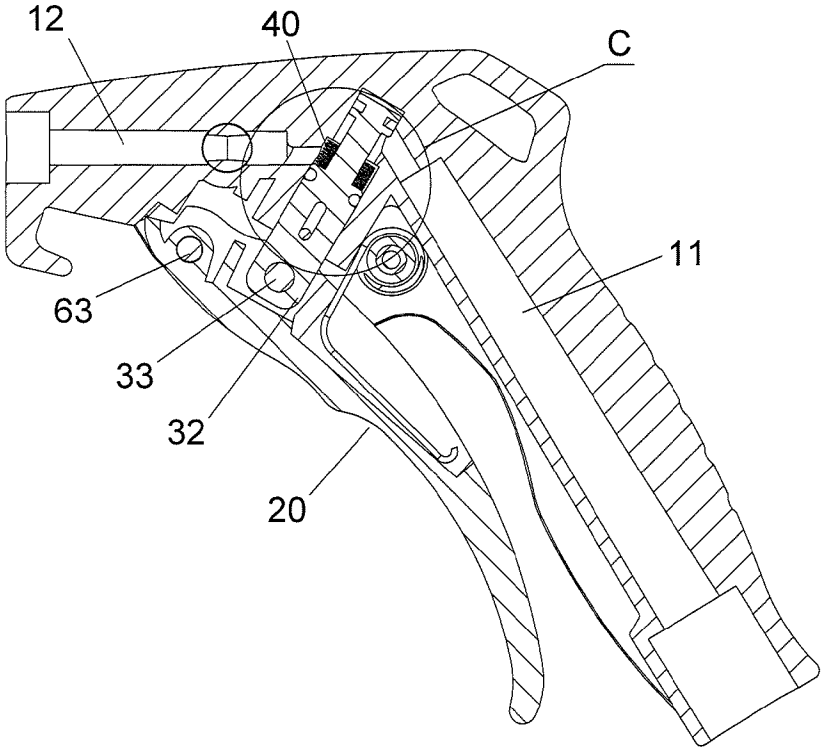
FIG. 14 shows a cross sectional view of the second embodiment of the blow gun of the present invention, showing another operational status.

As shown in FIGS. 14 and 15, when the user pulls the trigger 20, the control member 32 and the end member 36 move within the first and second rooms 13, 14. The control member 32 compresses the first spring 40, and the first pin 61 contacts the other inner end of the slot 321. The first room 13 is opened, and there is a gap between the control member 32 and the second room so that the second room 14 communicates with the first room 13. The pressurized air enters into the second room 14 and the first room 13 via the first path 11, and the pressurized air exits from the blow gun via the second path 12.

In another embodiment, the control member 32 and the bar 33 are integral to each other, and the fifth pivotal portion 322 of the control member 32 is shaped as the bar 33. The end member 36 and the collar 37 are integral to each other. The first hole 16 has inner threads to which the first pin 61 is threadedly connected. The first pivotal portion 18 has inner threads to which the third pin 63 is threadedly connected.

The advantages of the present invention are that when the trigger 20 is pulled, the first and second spring 40, 50 share the force applied thereto so that the service life of the two springs 40, 50 are prolonged. When one of the two springs 40, 50 fails, the other spring is useable to maintain the function of the blow gun.

When the user pulls the trigger 20, the trigger 20, the end member 36 and the collar 37 move within the first and second rooms 13, 14. Because the outer diameter of first end of the control member 32 is the same as the inner diameter of the first room 13, and the outer diameter of the second end of the control member 32 is smaller than the inner diameter of the first and second rooms 13, 14, so that when the control member 32 moves inward, the end member 36 moves to compress the first spring 40. The first room 13 is opened, and there is a gap between the control member 32 and the second room so that the second room 14 communicates with the first room 13, and the first path 11 communicates with the second path 12. The pressurized air enters into the second room 14 and the first room 13 via the first path 11, and the pressurized air exits from the blow gun via the second path 12.

As shown in FIG. 8, when the pressure of the pressurized air is so high that the pressure directly applies to the control member 32 and the end member 36. The pressure applied to the control member 32 is shared by the trigger 20 and the third pin 36. When the control member 32 returns, the first pin 61 contacts one of two inner ends of the slot 321, the first pin 61 shares a portion of the pressure applied to the control member 32. In other words, the first and third pins 61, 63 both share the pressure, the possibility of damage to the two pins 61, 63 is reduced.

When the friction of the seal ring 34 and the collar 37 is larger than the resilient force of the first and second springs 40, 50, such that the control member 32 cannot returns, the user can pull the trigger to return the control member 32.

As shown in FIGS. 11 to 15, the control member 32 and the end member 36 are integral to each other, and the first spring 40 is received in the first room 13 and mounted to the control member 32. The first spring 40 is biased between the control member 32 and the shoulder 15. When the trigger 20 is pulled, the control member 32 and the end member 36 move in the first room 13 and the second room 14, the control member 32 compresses the first spring 40 to compress the first spring 40 against the shoulder 15.

While we have shown and described the embodiment in accordance with the present invention, it should be clear to those skilled in the art that further embodiments may be made without departing from the scope of the present invention.

What is claimed is:

1. A blow gun comprising:

a body having a first path for introducing air into the body, and a second path for releasing air out from the body, a first room and a second room located between the first and second paths, the first room communicating with the second path, the second room communicating with the first path, the first and second rooms communicating with each other, a diameter of the first room being larger than that of the second room so as to form a shoulder between the first and second rooms, a first hole defined in the body and located adjacent to an opening of the first room, the first hole communicating with the first room, a first pivotal portion defined in the body and located adjacent to the second path, a second pivotal portion defined in the body and located adjacent to the first path;

a trigger having a third pivotal portion which faces the body and is pivotably connected to the first pivotal portion, a fourth pivotal portion being an elongate hole and defined through the trigger;

a control unit located between the body and the trigger, the control unit having a control member, a bar, a seal ring, an end member, a collar and a fastening member;

the control member received in the first room and having a slot which is located corresponding to the first hole, a fifth pivotal portion defined in a first end of the control member and being pivotably connected to the fourth pivotal portion of the trigger, a connection portion defined in a second end of the control member and having inner threads, a groove defined in an outside of the control member and located adjacent to the slot;

the bar pivotably extending through the fourth and fifth pivotal portions to pivotably connect the trigger to the control member;

the seal ring engaged with the groove of the control member so that an inner periphery of the first room snugly contacts the outside of the control member;

the end member being a ring-shaped member and connected to the second end of the control member;

the collar mounted to a protrusion of the end member and located between the control member and the end member, the collar being located to seal the first path relative to the second path, the collar sealing the second room, an outer diameter of the collar and the end member being equal to an inner diameter of the second room;

the fastening member extending through the end member and threadedly connected to the connection portion of the control member to connect the end member, the collar and the control member together, when the control member moves in the first room, the control member drives the end member and the collar to move in the second room;

when the trigger is pivoted, the trigger drives the control member to move within the first and second rooms, the end member and the collar are moved with the control member so that the collar does not locate at the opening of the first room such that the first path communicates with the second path;

a first spring being biased between an inner end of the second room of the body and the end member of the control unit so as to provide a recovery force to the control member, the end member and the collar;

a second spring located in a third room of the trigger and being biased between the body and the trigger, the second spring providing a recovery force to the trigger, the second spring being a torsion spring and having a central hole which is located corresponding to the second pivotal portion;

a first pin extending through the first hole and located in the slot, the first pin being movable within the slot, when the control member moves in the first room, the first pin and the slot restrict a maximum movement of the control member, when the control member returns, the first pin contacts one of two inner ends of the slot;

a third pin pivotably extending through the first and third pivotal portions to pivotably connect the trigger to the body, and a fourth pin pivotably extending through the second pivotal portion and the central hole of the second spring to restrict the second spring from disengaging from the body.

2. The blow gun as claimed in claim 1, wherein the control member and the end member are integral to each other.

3. The blow gun as claimed in claim 1, wherein the control member and the bar are integral to each other, the fifth pivotal portion of the control member is shaped as the bar.

4. The blow gun as claimed in claim 1, wherein the end member and the collar are integral to each other, the first hole has inner threads to which the first pin is threadedly connected, the first pivotal portion has inner threads to which the third pin is threadedly connected.

5. A blow gun comprising:

a body having a first path for introducing air into the body, and a second path for releasing air out from the body, a first room and a second room located between the first and second paths, the first room communicating with the second path, the second room communicating with the first path, the first and second rooms communicating with each other, a diameter of the first room being larger than that of the second room so as to form a shoulder between the first and second rooms, a first hole defined in the body and located adjacent to an opening of the first room, the first hole communicating with the first room, a first pivotal portion defined in the body and located adjacent to the second path, a second pivotal portion defined in the body and located adjacent to the first path;

a trigger having a third pivotal portion which faces the body and is pivotably connected to the first pivotal portion, a fourth pivotal portion being an elongate hole and defined through the trigger;

a control unit located between the body and the trigger, the control unit having a control member, a bar, a seal ring, an end member, a collar and a fastening member;

the control member received in the first room and having a slot which is located corresponding to the first hole, a fifth pivotal portion defined in a first end of the control member and being pivotably connected to the fourth pivotal portion of the trigger, a connection portion defined in a second end of the control member and having inner threads, a groove defined in an outside of the control member and located adjacent to the slot;

the bar pivotably extending through the fourth and fifth pivotal portions to pivotably connect the trigger to the control member;

the seal ring engaged with the groove of the control member so that an inner periphery of the first room snugly contacts the outside of the control member;

the end member being a ring-shaped member and connected to the second end of the control member;

the collar mounted to a protrusion of the end member and located between the control member and the end member, the collar being located to seal the first path relative to the second path, the collar sealing the second room, an outer diameter of the collar and the end member being equal to an inner diameter of the second room;

the fastening member extending through the end member and threadedly connected to the connection portion of the control member to connect the end member, the collar and the control member together, when the control member moves in the first room, the control member drives the end member and the collar to move in the second room;

when the trigger is pivoted, the trigger drives the control member to move within the first and second rooms, the end member and the collar are moved with the control member so that the collar does not locate at the opening of the first room such that the first path communicates with the second path;

a first spring being received in the first room and mounted to the control member, the first spring is biased between the control member and the shoulder, so as to provide a recovery force to the control member, the end member and the collar;

a second spring located in a third room of the trigger and being biased between the body and the trigger, the second spring providing a recovery force to the trigger, the second spring being a torsion spring and having a central hole which is located corresponding to the second pivotal portion;

a first pin extending through the first hole and located in the slot, the first pin being movable within the slot, when the control member moves in the first room, the first pin and the slot restrict a maximum movement of the control member, when the control member returns, the first pin contacts one of two inner ends of the slot;

a third pin pivotably extending through the first and third pivotal portions to pivotably connect the trigger to the body, and a fourth pin pivotably extending through the second pivotal portion and the central hole of the second spring to restrict the second spring from disengaging from the body.

* * * * *